US006910337B2

(12) United States Patent
Flohr et al.

(10) Patent No.: US 6,910,337 B2
(45) Date of Patent: Jun. 28, 2005

(54) METHOD AND APPARATUS FOR STORING LIQUIDS AND LIQUEFIED GASES

(75) Inventors: Felix Flohr, Hildesheim (DE); Christoph Meurer, Hannover (DE)

(73) Assignee: Solvay Flour und Derivate GmbH, Hannover (DE)

( * ) Notice: Subject to any disclaimer, the term of this patent is extended or adjusted under 35 U.S.C. 154(b) by 0 days.

(21) Appl. No.: 10/683,467

(22) Filed: Oct. 14, 2003

(65) Prior Publication Data

US 2004/0134201 A1 Jul. 15, 2004

Related U.S. Application Data

(63) Continuation of application No. PCT/EP02/03057, filed on Mar. 20, 2002.

(30) Foreign Application Priority Data

Apr. 12, 2001 (DE) ..... 101 18 361

(51) Int. Cl.[7] ..... F17C 13/02
(52) U.S. Cl. ..... 62/49.1
(58) Field of Search ..... 62/46.1, 77, 49.1, 62/47.1; 137/87.01, 87.04, 88, 3; 141/2, 18

(56) References Cited

U.S. PATENT DOCUMENTS

| | | | | |
|---|---|---|---|---|
| 2,390,694 A | * | 12/1945 | Coyle, Jr. | 141/3 |
| 3,668,882 A | * | 6/1972 | Sarsten et al. | 62/77 |
| 4,445,366 A | * | 5/1984 | Gray | 73/64.46 |
| 5,186,012 A | * | 2/1993 | Czachorski et al. | 62/114 |
| 5,285,648 A | * | 2/1994 | Bessler | 62/129 |
| 5,709,093 A | * | 1/1998 | Cerri et al. | 62/114 |
| 6,000,230 A | * | 12/1999 | Kanno et al. | 62/77 |

FOREIGN PATENT DOCUMENTS

EP 1 008 799 6/2000

* cited by examiner

*Primary Examiner*—Denise L. Esquivel
*Assistant Examiner*—Richard L. Leung
(74) *Attorney, Agent, or Firm*—Crowell & Moring LLP

(57) ABSTRACT

The invention relates to a method for storing liquefied zeotropic gas mixtures. To ensure a composition of the liquid phase which meets specifications, the change of the gas phase is determined by means of a differential pressure transducer by comparing the pressure with a calibration mixture. The mixture composition of the liquid phase is regulated by subsequently metering in the mixture components which have the higher partial pressure.

7 Claims, 1 Drawing Sheet

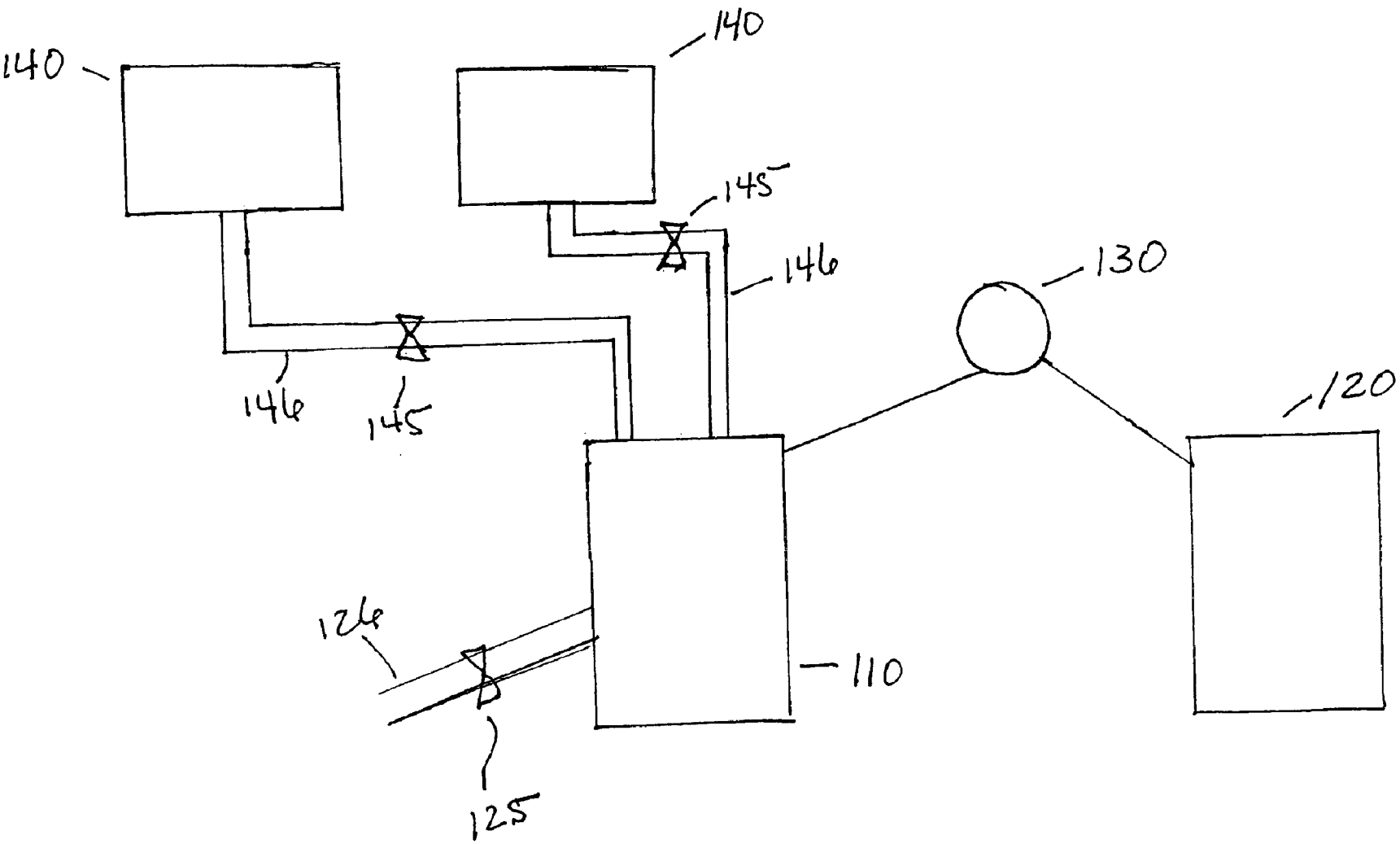
120
130
110
140
145
146
145
146
140
125
126

METHOD AND APPARATUS FOR STORING LIQUIDS AND LIQUEFIED GASES

CROSS REFERENCE TO RELATED APPLICATIONS

This application is a continuation of International Patent Application No. PCT/EP02/03057, filed Mar. 20, 2002, designating the United States of America, and published in German as WO 02/084168, the entire disclosure of which is incorporated herein by reference. Priority is claimed based on Federal Republic of Germany patent application no. DE 101 18 361.5, filed Apr. 12, 2001.

FIELD OF THE INVENTION

The invention relates to a method and an apparatus for ensuring a constant mixture composition when storing liquids and liquefied gases.

BACKGROUND OF THE INVENTION

Liquids and liquefied gases are stored in closed containers, from which they are transferred into other containers, which in turn may serve as storage containers for transferring into even smaller containers.

In the case of gases liquefied under pressure, removal is effected by means of inherent pressure. In the case of pressure-liquefied gases which consist of more than one component, there is the risk that, depending on the filling level and temperature in the respective container, a gas phase of greater or lesser volume will be produced, which differs from the liquid phase in its proportional composition.

In the case of liquefied gas mixtures, thus the composition of the gaseous or liquid phase may vary according to the temperature of the mixture and the ratio of gas and liquid volumes. When the container level drops, the composition of the mixture in the gas phase and also in the liquid phase thus changes. This change in composition may result in the mixture composition no longer corresponding to the composition of the mixture as originally introduced.

This problem occurs, for example, in the storage of liquefied gases for refrigeration purposes. Both azeotropic mixtures and zeotropic mixtures are used in refrigeration. In zeotropic mixtures the compositions of the gas phase and the liquid phase which is in equilibrium therewith are not identical.

The refrigerant R407C contains HFC32, HFC125 and HFC134a in a weight ratio of 23:25:52 with a tolerance of ±2% by weight per component in accordance with ARI 700/ASHRAE 34/DIN 8960. If this zeotropic mixture is stored in a conventional container and the liquid phase is removed from this container, it is noted that enrichment of HFC134a and depletion of the other two components occurs in the liquid phase. Correspondingly, depletion of HFC134a and enrichment of the other two components occurs in the gas phase. This shift in the composition is undesirable, since associated disruptions may occur in the refrigeration plant, which is set to a given mixture composition. The intended refrigeration performance cannot, for example, be achieved.

JP 8-4997 describes a method with which the changes in concentration when storing liquefied gases and removing them from the storage containers can be avoided. According to this method, either an inert gas or the gas component of the liquefied gas mixture which has the lower boiling point and therefore is enriched in the gas phase is introduced under pressure into the storage container simultaneously with the removal of the gas.

SUMMARY OF THE INVENTION

The object of the invention is to devise a method and an apparatus with which the aforementioned problems no longer arise. This object is achieved by the method according to the invention and the associated apparatus.

In an embodiment, the present invention provides a method for determining and adjusting the composition of a mixture of liquids or liquefied gases. The method comprises determining a change in composition of a mixture of liquids or liquefied gases by comparing a pressure of said mixture of liquids or liquefied gases with a pressure of a calibration mixture, and regulating the composition of said mixture of liquids or liquefied gases by metering in a component of said mixture of liquids or liquefied gases having a higher partial pressure.

In various embodiments, the mixture of liquids and liquefied gases can be a zeotropic mixture, such as a zeotropic mixture of pressure-liquefied gases. The mixture of liquids and liquefied gases can comprise a mixture of refrigerants. The pressure of the mixture of liquids or liquefied gases can be compared with the pressure of the calibration mixture using a differential pressure transducer. In an embodiment, the mixture of liquids or liquefied gases contains two or more components, and the calibration mixture also contains the same two or more components. The composition of the liquid phase of the calibration mixture can correspond to a composition within a specified tolerance for the liquid phase of the mixture of liquids or liquefied gases.

In another embodiment, the present invention provides an apparatus for determining and regulating the composition of a zeotropic mixture in a storage container. The apparatus comprises a differential pressure transducer which is connected to a first container containing a mixture of liquids or liquefied gases and which is connected to a second container containing a calibration mixture.

The method according to the invention is suitable for the storage of liquids and liquefied gases, in particular for the storage of liquefied gases, e.g. of pressure-liquefied, zeotropic gas mixtures, in particular zeotropic refrigerants.

In one embodiment, the method according to the invention is characterized in that the change in the gas phase composition is determined by means of a differential pressure transducer which is connected to a container in which a calibration mixture is located, and to the storage container.

If the indicated pressure difference departs from a certain range of values, the original mixture composition, in particular of the liquid phase, is re-established by subsequently metering in the gas components which have the higher partial pressure.

The subsequent metering takes place until the pressure difference value passes beyond the previously established pressure difference range in the other direction.

BRIEF DESCRIPTION OF THE DRAWINGS

FIG. 1 schematically shows an apparatus according to an embodiment of the present invention.

DETAILED DESCRIPTION OF EMBODIMENTS

The pressure difference between the calibration mixture and the gas phase in the storage container is determined by means of the differential pressure transducer used.

A mechanical display unit, an electronic sensor or alternatively a U-tube may for example be used as differential pressure transducer.

The components of the mixture to be stored are used as calibration mixture. The composition of the calibration mixture depends on the acceptable composition of the liquid phase of the mixture in the storage tank.

In one embodiment, HFC407c is stored in a closed large container. The liquid phase is removed from the container. To ensure the fluid composition, a mixture of HFC32 and HFC125 is subsequently metered into the storage tank. This is done until the pressure in the storage tank has reached an upper limit value, which can be read off via the differential pressure transducer.

Since the differential pressure transducer operates very accurately and is available as an electronic component, linking of the measuring points to an online process control is possible.

The differential pressure transducer and the container for the calibration mixture may be located next to, on or in the storage container.

It has been found that with relatively little expense subsequent metering of the gas components can be monitored and the liquefied gas in its composition both in the gas and in the liquid phase can be maintained at a given composition with an extremely low fluctuation tolerance. The costly checking of the composition by means of GC analysis, which was conventional hitherto, can thus be dispensed with.

FIG. 1 schematically shows an apparatus according to an embodiment of the present invention. Container 110 contains a mixture of liquids or liquefied gases. Calibration container 120 contains a calibration mixture. Differential pressure transducer 130 is connected to both container 110 and calibration container 120 to allow for comparison of the pressures in the containers. Valve 125 can be opened and closed to permit gas flow out of container 110 via exit conduit 126. Exit conduit 126 leads to a system or process that will make use of the gas flow.

When a pressure difference is detected between the gases in calibration container 120 and the mixture in container 110, one or more of the mixture components are metered into container 110 from component reservoirs 140. In the embodiment shown in FIG. 1, each component reservoir is connected to container 110 by a delivery conduit 146. The fluid flow in a delivery conduit 146 is controlled by a valve 145.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A method for determining and adjusting the composition of a mixture of liquids or liquefied gases in a storage container, said method comprising:

determining a change in composition of a mixture of liquids or liquefied gases by comparing a pressure of said mixture of liquids or liquefied gases with a pressure of a calibration mixture using a differential pressure transducer; and regulating the composition of said mixture of liquids or liquefied gases by metering in a component of said mixture of liquids or liquefied gases having a higher partial pressure.

2. The method of claim 1, wherein said mixture of liquids or liquefied gases is a zeotropic mixture.

3. The method of claim 1, wherein said mixture of liquids or liquefied gases comprises a zeotropic mixture of pressure-liquefied gases.

4. The method of claim 1, wherein said mixture of liquids or liquefied gases comprises a mixture of refrigerants.

5. A method according to claim 1, wherein said mixture of liquids or liquefied gases contains two or more components, and wherein the calibration mixture contains said two or more components.

6. A method according to claim 1, wherein the composition of a liquid phase of the calibration mixture corresponds to a composition within a specified tolerance for the liquid phase of said mixture of liquids or liquefied gases.

7. An apparatus for determining and regulating the composition of a zeotropic mixture in a storage container, comprising a differential pressure transducer which is connected to a first container containing a mixture of liquids or liquefied gases and which is connected to a second container containing a calibration mixture.

* * * * *